US012251746B2

(12) United States Patent
Fontayne

(10) Patent No.: US 12,251,746 B2
(45) Date of Patent: Mar. 18, 2025

(54) ROLL STAND FOR ROLLING A METAL PRODUCT

(71) Applicant: SMS Group GmbH, Duesseldorf (DE)

(72) Inventor: Dietmar Fontayne, Hilchenbach (DE)

(73) Assignee: SMS Group GmbH, Duesseldorf (DE)

( * ) Notice: Subject to any disclaimer, the term of this patent is extended or adjusted under 35 U.S.C. 154(b) by 168 days.

(21) Appl. No.: 16/609,818

(22) PCT Filed: Apr. 13, 2018

(86) PCT No.: PCT/EP2018/059529

§ 371 (c)(1),
(2) Date: Nov. 15, 2019

(87) PCT Pub. No.: WO2018/202404

PCT Pub. Date: Nov. 8, 2018

(65) Prior Publication Data

US 2024/0278302 A1 Aug. 22, 2024

(30) Foreign Application Priority Data

May 3, 2017 (DE) ..... 102017207384.5
Nov. 17, 2017 (DE) ..... 102017220560.1

(51) Int. Cl.
*B21B 31/18* (2006.01)

(52) U.S. Cl.
CPC ..... *B21B 31/18* (2013.01); *B21B 2269/04* (2013.01); *B21B 2269/12* (2013.01)

(58) Field of Classification Search
CPC ..... B21B 31/16; B21B 31/18; B21B 2269/02; B21B 2269/04; B21B 2269/12
See application file for complete search history.

(56) References Cited

U.S. PATENT DOCUMENTS 5,090,228 A * 2/1992 Schmiedberg ..... B21B 31/106 72/247
5,657,655 A * 8/1997 Yasuda ..... B21B 37/32 72/236

(Continued)

FOREIGN PATENT DOCUMENTS

AT 509455 9/2011
DE 102011082372 3/2007

*Primary Examiner* — Teresa M Ekiert
(74) *Attorney, Agent, or Firm* — Amster, Rothstein & Ebenstein LLP

(57) ABSTRACT

A roll stand for rolling a metallic product and having two work-rolls supported in the roll stand by respective work-roll chocks. An axial displacement arrangement is provided with which the work-rolls can be displaced in direction of their longitudinal axes, and at least one work-roll locking arrangement is provided with which the work-roll chocks can be locked and unlocked in the roll stand. A rotation prevention arrangement is provided with which the axial displacement arrangement can be prevented from rotation about longitudinal axes of the work-roll. A bending arrangement is provided which includes a bending block and with which a bending torque can be applied to the work-rolls. In order to achieve a simpler design of the assembly and improved lubrication possibilities for the component to be lubricated, the rotation prevention arrangement and the axial displacement arrangement are fixedly connected with the bending block.

9 Claims, 3 Drawing Sheets

(56) References Cited

U.S. PATENT DOCUMENTS

| | | | | |
|---|---|---|---|---|
| 2007/0107472 | A1 | 5/2007 | Kim | |
| 2007/0129228 | A1 | 6/2007 | Zieser et al. | |
| 2013/0125602 | A1* | 5/2013 | Sandrin | B21D 5/00 72/211 |

* cited by examiner

ROLL STAND FOR ROLLING A METAL PRODUCT

RELATED APPLICATIONS

This application is a National Stage application of International application PCT/EP2018/059529 filed Apr. 13, 2018 and claiming priority of German applications DE 10 2017 207384.5 filed May 3, 2017 and DE 10 2017 220560.1 filed Nov. 17, 2017, all three of the applications are incorporated herein by reference thereto.

BACKGROUND OF INVENTION

Field of Invention

The invention relates to a roll stand for rolling a metallic product and having two work rolls supported in the roll stand by respective work roll chocks, wherein axial displacement means is provided with which the work rolls can be displaced in direction of their longitudinal axes, wherein at least one work roll locking means is provided with which the work roll chocks can be locked and unlocked in the roll stand, wherein rotation prevention means is provided with which the axial displacement means can be prevented from rotation about longitudinal axes of the work rolls, and wherein bending means is provided which includes a bending block and with which a bending torque can be applied to the work rolls.

Background of Related Art

Such roll stand is disclosed, for example, in European Patent EP 1648 626 B1. The principle design of a such roll stand is shown in FIG. 1. The roll stand which is shown here, has two arranged one above the other work rolls which are supported in respective work roll chocks 2. For axial displacement of the work rolls, i.e., for displacement in direction of the longitudinal axis, axial displacement means 3 is provided. For applying a bending torque to the work rolls in order to influence the roll gap, there is provided, in a bending block 5 (for both the upper and lower work rolls), a bending cylinder 12. For displacement of the work rolls in the roll stand or roll housing, a releasable connection between work roll chocks 2 of the rolls and the displacement device 3 is necessary. The releasable connection is provided by work roll locking means 4. The locking or unlocking is carried out by displacement of a tongue displaceable by displacement means 8.

Thus, the roll stand 1 includes a bending and displacing system for the work rolls with work roll locking means. The axial displacement means (displacement device) 8 is secured, in the direction of the longitudinal axis of the work roll, in front of the bending block 5, directly on the roll housing 13 or on the bending block 5.

For work rolls to be able to be displaced along their longitudinal axes, a connection between the displacement device 8 and the work roll chocks 2 should be established. On one hand, this connection should be stable to enable displacement under rolling and bending forces, and on the other hand, it should be releasable to provide for roll exchange. This connection is provided by the work roll locking means 4. Upon locking, the above-mentioned tongue is pivoted, as a rule, by a hydraulically actuated lever connection, about the axis of the displacement device 8 into a side recess in the work roll chock 2, providing, thus, a connection between the displacement mechanism 3 and the chock 2. The purpose of the additional rotation prevention means 11 is to keep the position of the displacement device 8 rotationally stable. With the known solution, the rotation prevention means 11 is secured on the roll housing 13 even when the axial displacement means 3 itself is secured on the bending block 5.

The attachment of the rotation prevention means 11 on the roll housing 13 leads to various disadvantages, in particular, when the associated axial displacement means 3 are secured on the bending block 5. Due to the symmetry of the roll stand 1, the roll stand 1 is equipped with four of each of the above-mentioned devices (on respective inlet and outlet sides of respective upper and lower rolls), however, this is a minor disadvantage (in a seven stand finishing train) but still a relevant factor:

The attachment of the rotation prevention means 11 to the roll housing 13 is carried out, with a known solution, using a guide block with a loop belt and an attachment screw. For this, it is necessary to mill the roll housing 13 at this location and, thus, during manufacturing, an expensive machining step is required.

The final assembly and adjustment of parts on the roll housing 13 can only be done on site because of separate attachments to the displacement cylinder and the roll housing, no pre-assembly is possible. Therefore, the time of assembly is disadvantageously extended.

The installation and removal of a bending block 5 is relatively difficult. E.g., for mounting a bending block 5 in the roll housing 13, simultaneously, a recess in the housing 13 and the two rotation prevention means 11 of the respective bending block 5 should be made, while the displacement device 3 has no rotationally stable position without the rotation prevention means 11.

Moreover, upon dismounting of the bending block 5 by turning the displacement device 3 over after "loss of the rotation prevention means," the displacement device 3 itself can be damaged and personnel injured.

At the attachment points of the roll housing 13, the guide surfaces should be lubricated. For grease lubrication, for each rotation prevention means, approximately two open lubrication points with "loss lubrication" are required, altogether, eight open grease lubrication points for a roll stand 1. This leads to grease escape, which contaminates the environment and the cooling water and occasionally, to burn marks on the surface of the to-be-rolled strip.

The rotation prevention means 11 mounted on the roll housing 13 makes the access to medium connections and conduit routing more difficult.

SUMMARY

The object of the invention is to so improve the state-of-the-art roll stand described above that the above-mentioned drawbacks are prevented or eliminated, and advantages in manufacturing and operation of a rolling stand can be achieved. In particular, the object of the invention is to achieve a simple assembly and advantages in lubrication of the roll stand. Thus, a simpler construction of the installation and improved lubrication possibilities of the to-be-lubricated components should be achieved.

These objects are achieved by the invention characterized in that the rotation prevention means and the axial displacement means are fixedly connected with the bending block.

The rotation prevention means, the axial displacement means, and the bending block form, advantageously, an integral unit.

The connection between the rotation prevention means, the axial displacement means, and the bending block is formed, advantageously, as a screw connection.

At least two, arranged one above the other, axial displacement means are secured on the bending block.

The work roll locking means is connected with the displacement means so that they form an operative connection.

The work roll locking means advantageously includes at least one tongue movable in a direction transverse to the direction of the longitudinal axis of the work roll. Thereby, displacement means is advantageously provided which can displace the tongue.

According to further development of the invention there is provided displacement locking means located between the axial displacement means and the bending block and which can be secured there in order to prevent displacement of the axial displacement means relative to the bending block.

A medium access (central) is advantageously formed on the bending block. Thereby, it can be provided that the medium access communicates with entrance for medium for the work roll locking means, for the axial displacement means, and for the bending block.

Advantageously, the medium access is connected with an appropriate piping. The proposed solution thereby ensures that the rotation prevention means is secured on the bending block, together with the axial displacement means (displacement device). Thereby, according to the proposed solution, an integral rotation prevention means is available for axially displaceable rolls.

A relatively simple constructive change provides a surprising number of advantages associated with manufacturing, assembly, servicing, and maintenance of a roll stand. As a result, the proposed solution is well suited for modernization and retrofitting of existing plants.

The proposed solution can be used, e.g., for flat rolling of metal strips, with the rolls being displaceable along their longitudinal axes, in particular, in hot rolling mills. It is generally also suitable for all other types of rolls.

BRIEF DESCRIPTION OF THE DRAWINGS

The drawings show exemplary embodiments of the invention.

In the drawings.

DETAILED DESCRIPTION

Figure 1:
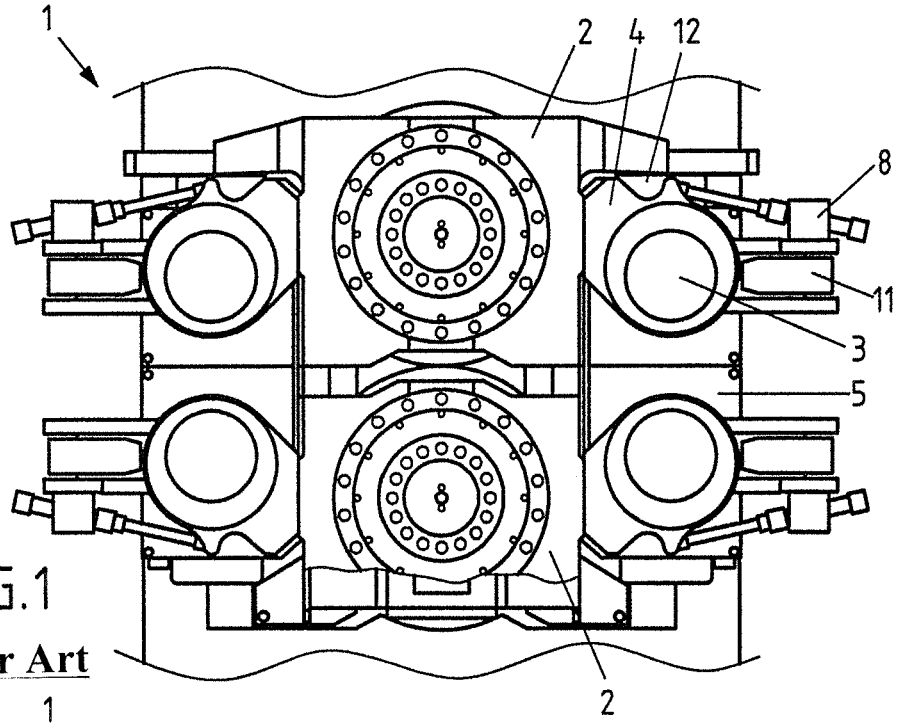
FIG.1 Prior Art
FIG. 1 shows a portion of a roll stand seen in the direction of the longitudinal axis of work rolls, which represents the solution according state-of-the-art.
Figure 2:
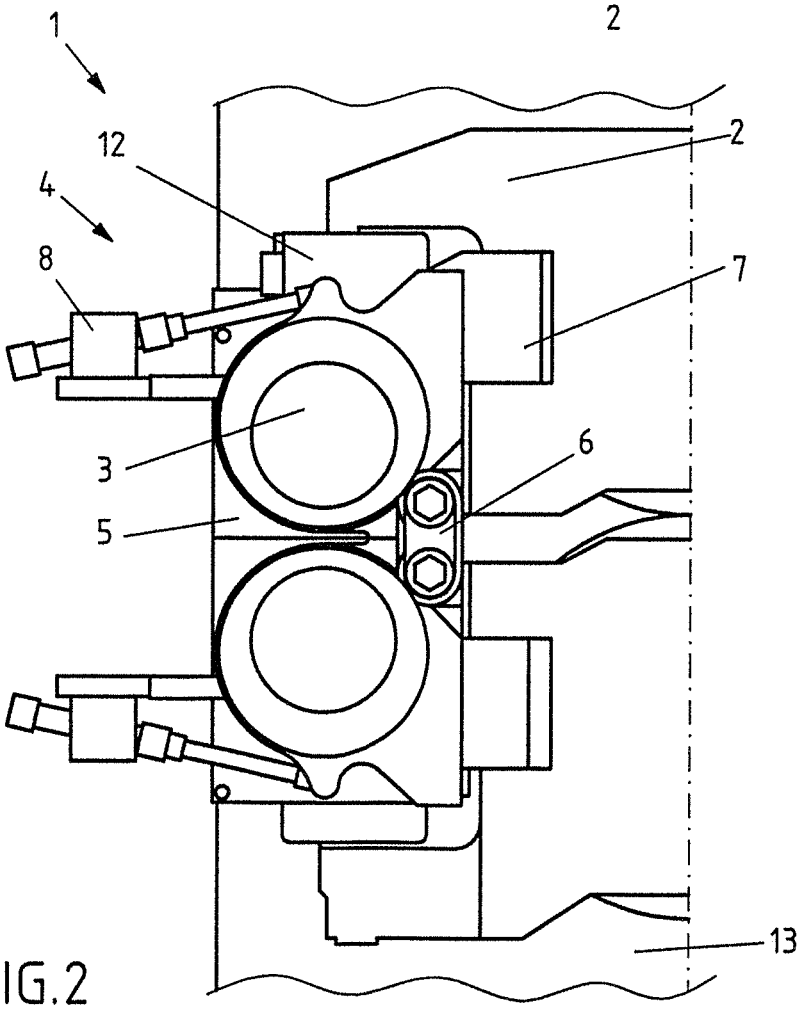
FIG. 2 shows a portion of a roll stand seen in the direction of the longitudinal axis of work rolls, which represents an embodiment according to the present invention.
Figure 3:
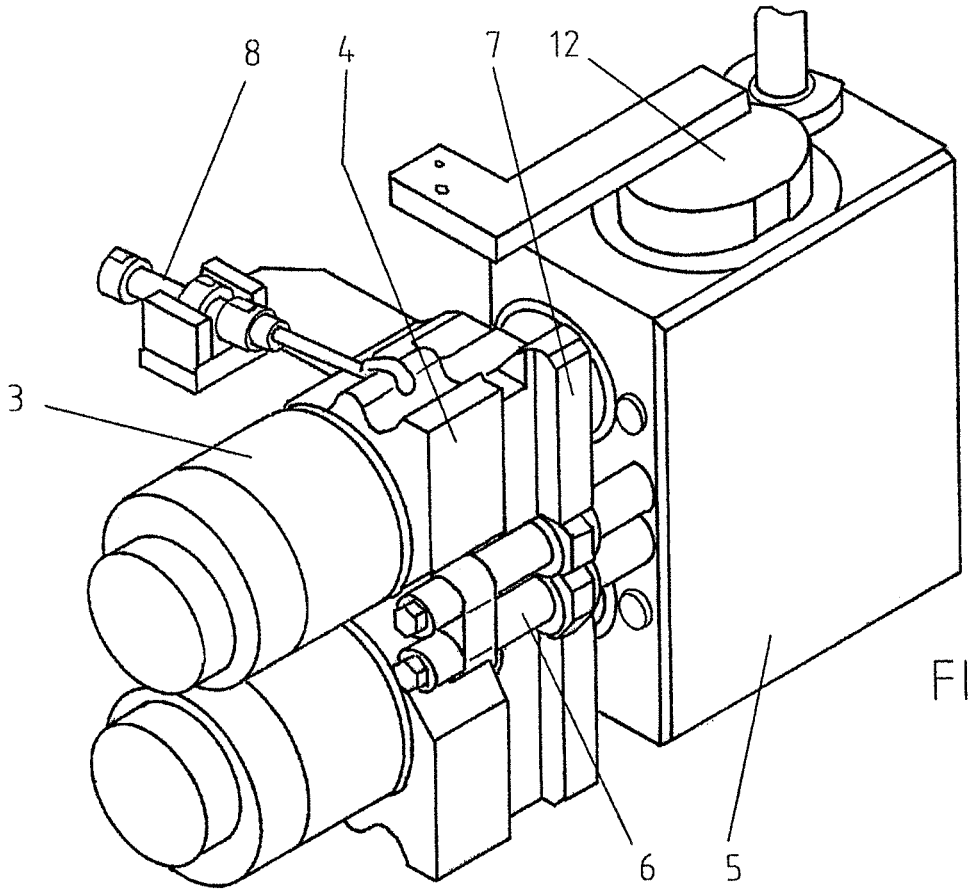
FIG. 3 shows a perspective view of the portion of the roll stand according to the embodiment of the invention shown in FIG. 2.

A roll stand 1 shown in FIGS. 2 and 3, in principle, has the same elements which were described in connection with the discussion in the state-of-the-art (with reference to FIG. 1). As discussed, the work rolls (not shown) are arranged in respective work roll chocks 2, wherein the work roll chocks 2 are located in a roll housing 13 of the roll stand 1. For displacement of the work roll in direction of their longitudinal axis, axial displacement means 3 is provided.

The work roll locking means 4 provides a connection between the axial displacement means 3 and the roll chock 2. To this end, for locking purposes, a tongue 7 is driven in a corresponding recess in the roll chock 2 by (hydraulic) displacement means 8.

Further, there is provided a bending block 5 in which a bending cylinder is located in order to apply, in a known manner, a bending torque to the work rolls to influence the profile of the roll gap.

Designing the axial displacement means 3 in form of a hydraulic cylinder requires, as a rule, that the axial displacement means 3 has a round outer shape. To avoid an undesired rotation, it should be supported against another component, without a possibility of rotation relative thereto. According to the invention, the axial displacement means 3 is supported against rotation by being supported against the bending block 5. To this end, there is provided a screw connection unit 6 formed of the above-mentioned elements, roll locking means 4, axial displacement means 3, and bending block 5. The screw connection unit 6 can be pre-assembled at the plant and then transported to an assembly site.

The above-mentioned connection of the locking means 4 with the bending block 5 by the screw connection 6, advantageously, is carried out simultaneously for both upper and lower rolls, with the bending block 5 being already equipped with respective cylinders 12 for the upper and lower work rolls.

To avoid open lubrication points, the bearing locations are combined. FIGS. 2 and 3 show that the bearing spots are already closed, preferably, with a round guide, so that for each roll housing, there are only four (4) points for one (1) closed bearing spot. Use of a sealed round guide means insures that the bearing spots are maintenance-free and, thus, 4 multiply by 2, that is eight (8) loss lubrication points are eliminated.

Figure 4:
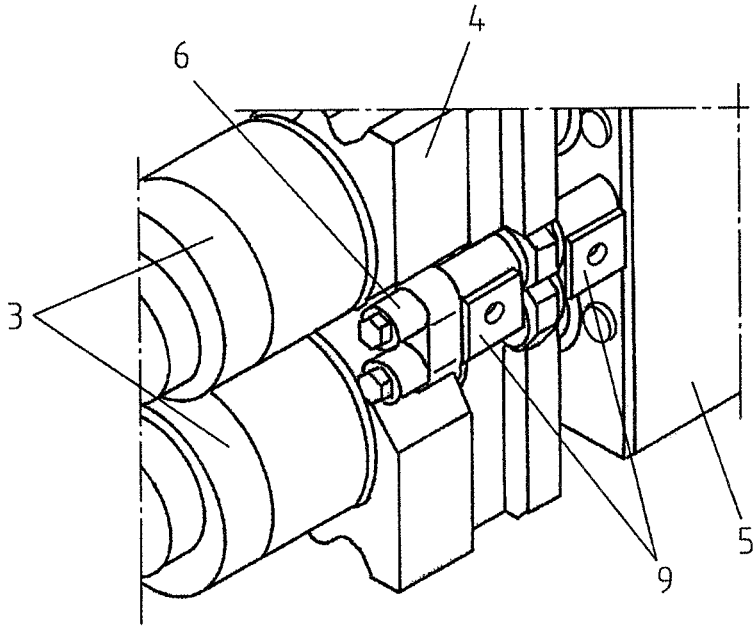
FIG. 4 shows a perspective view of a section of FIG. 3 at an increased scale, which shows an arrangement of the displacement prevention means.

For an integral unit formed of axial displacement means (displacement device), rotation preventing means, and bending block, displacement locking means 9 is provided, as shown in FIG. 4. The displacement locking means 9 secures the displacement device 3 in a predetermined position relative to the bending block 5. In this way, damage or injury from moving parts can be prevented.

Figure 5:
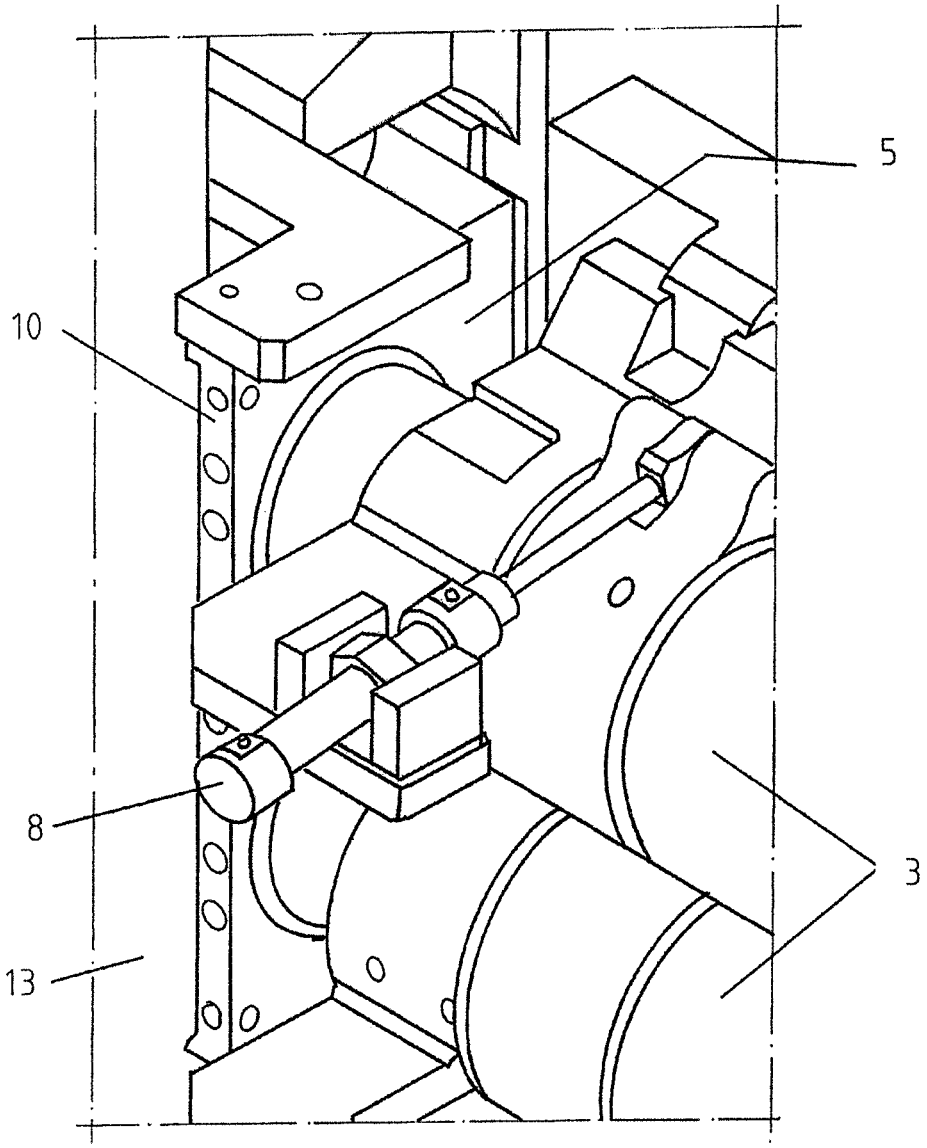
FIG. 5 shows a perspective view of a section of the roll stand, illustrating the medium access.

A further advantageous embodiment or effect of the proposed solution is illustrated in FIG. 5. It shows that an improved access of the medium connection, which results from elimination of the attachments to the roll housing, becomes possible. Further, thereby, a hard connection of all of the tubular junctions becomes possible. Potential leak points are reduced, and the piping system of the roll housing can be substantially simplified.

Thus, the entire stand is substantially simplified, whereby substantial advantages in manufacturing and on-site assembly, and particularly, in maintenance of the roll stand are achieved.

LIST OF REFERENCE NUMERALS

1 Roll stand
2 Work roll chock
3 Axial displacement means
4 Work roll locking means
5 Bending block
6 Rotation prevention means

7 Tongue
8 Displacement means
9 Displacement prevention means
10 Medium access
11 Means for securing rotation prevention means to a roll housing
12 Bending cylinder
13 Roll housing

The invention claimed is:

1. A roll stand for rolling a metallic product comprising:
two work rolls supported in the roll stand by respective work roll chocks;
an axial displacement means with which the two work rolls can be displaced in direction of their longitudinal axes,
at least one work roll locking means with which the work roll chocks can be locked and unlocked in the roll stand,
rotation prevention means with which the axial displacement means can be prevented from rotation about longitudinal axes of each of the two work rolls,
bending means which includes a bending block and with which a bending torque can be applied to the two work rolls, and
wherein the at least one work roll locking means, the rotation prevention means and the axial displacement means are fixedly connected with the bending block.

2. The roll stand according to claim 1, wherein the rotation prevention means, the axial displacement means, and the bending block form an integral unit.

3. The roll stand according to claim 1, wherein connection of the at least one work roll locking means, the axial displacement means, and the bending block is formed as a screw connection.

4. The roll stand according to claim 1, wherein two, arranged one above the other, axial displacement means are secured on the bending block.

5. The roll stand according to claim 1, wherein a releasable displacement locking means is provided which is located between the axial displacement means and the bending block and can be secured there in order to prevent displacement of the axial displacement means relative to the bending block.

6. The roll stand according to claim 1, wherein a medium access is provided on the bending block.

7. The roll stand according to claim 6, wherein the medium access communicates with an entrance for medium for the at least one work roll locking means, for the axial displacement means, and for the bending block.

8. The roll stand according to claim 6, wherein the medium access is connected with piping.

9. The roll stand according to claim 7, wherein the medium access is connected with piping.

* * * * *